US010297933B2

(12) United States Patent
Wu et al.

(10) Patent No.: US 10,297,933 B2
(45) Date of Patent: May 21, 2019

(54) WIRE PLUG-IN AID SLEEVE STRUCTURE FOR WIRE CONNECTION TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wen Bing Hsu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/979,650

(22) Filed: May 15, 2018

(65) Prior Publication Data

US 2018/0337472 A1 Nov. 22, 2018

(30) Foreign Application Priority Data

May 16, 2017 (TW) ..... 106206955 U

(51) Int. Cl.

| | |
|---|---|
| ***H01R 9/24*** | (2006.01) |
| ***H01R 4/48*** | (2006.01) |
| ***H01R 4/22*** | (2006.01) |
| *H01R 9/26* | (2006.01) |
| *H01R 24/20* | (2011.01) |
| *H01R 13/58* | (2006.01) |

(52) U.S. Cl.

CPC ..... *H01R 9/2416* (2013.01); *H01R 4/22* (2013.01); *H01R 4/48* (2013.01); *H01R 4/4827* (2013.01); *H01R 4/4836* (2013.01); *H01R 9/2491* (2013.01); *H01R 9/26* (2013.01); *H01R 13/58* (2013.01); *H01R 24/20* (2013.01)

(58) Field of Classification Search

CPC ..... H01R 9/2416

See application file for complete search history.

(56) References Cited

U.S. PATENT DOCUMENTS

| | | | | |
|---|---|---|---|---|
| 4,341,430 A * | 7/1982 | Crawford | H01R 12/675 | 439/409 |
| 6,152,760 A * | 11/2000 | Reeser | H01R 4/2433 | 439/395 |
| 6,406,324 B1 * | 6/2002 | Duesterhoeft | H01R 4/2433 | 439/409 |
| 6,619,997 B1 * | 9/2003 | Wilson | H01R 9/2416 | 439/371 |
| 7,144,269 B2 * | 12/2006 | Libby | H01R 4/2412 | 439/409 |
| 7,404,745 B1 * | 7/2008 | Wu | H01R 4/26 | 439/709 |

(Continued)

*Primary Examiner* — James Harvey

(74) *Attorney, Agent, or Firm* — Rosenberg, Klein & Lee

(57) ABSTRACT

A wire plug-in aid sleeve structure for wire connection terminal is assembled in a wire plug-in hole of the terminal. The aid sleeve includes a head section, a belly section connected with the head section and a tail section connected with the belly section. The head section, the belly section and the tail section together define a guide hole for the conductive wire to plug in. The tail section has a first side and a second side positioned on a peripheral section of the guide hole. After the conductive wire passes through the guide hole into the terminal, the metal leaf spring disposed in the terminal is facilitated to press the conductive wire toward the first side or second side.

32 Claims, 6 Drawing Sheets

(56) References Cited

U.S. PATENT DOCUMENTS

| | | | | |
|---|---|---|---|---|
| 7,503,797 | B2 * | 3/2009 | Lappoehn | H01R 4/2433 439/404 |
| 7,794,267 | B2 * | 9/2010 | Daily | H01R 4/2433 439/402 |
| 2003/0026647 | A1 * | 2/2003 | Sasaki | H02G 15/013 403/288 |
| 2004/0115983 | A1 * | 6/2004 | Liang | H01R 13/6461 439/344 |
| 2008/0311796 | A1 * | 12/2008 | Washburn | G01R 1/0416 439/669 |
| 2018/0166802 | A1 * | 6/2018 | Lin | H01R 4/4836 |

* cited by examiner

WIRE PLUG-IN AID SLEEVE STRUCTURE FOR WIRE CONNECTION TERMINAL

BACKGROUND OF THE INVENTION

1. Field of the Invention

The present invention relates generally to a wire plug-in aid sleeve structure for wire connection terminal, and more particularly to an aid sleeve mounted in a wire plug-in hole of the terminal to guide a conductive wire and help in fixing the conductive wire.

2. Description of the Related Art

A conventional terminal device or wire pressing terminal has an insulation case (generally made of plastic material), a metal component (or so-called electrical conductive component) and a leaf spring conductor (or so-called metal leaf spring). The metal component and the leaf spring conductor are enclosed in the insulation case to press and electrically connect with or release a conductive wire plugged in the terminal device.

Such electrical terminal device can be generally classified into three types. The first type of electrical terminal device is inserted on a circuit board.

The second type of electrical terminal device is latched with a grounding rail (or conductive rail) in a row to set up a common grounding device of an electrical apparatus or mechanical equipment for conducting out the residual voltage or static of the machine.

Such electrical terminal device (or rail-type electrical connection terminal) generally includes an insulation case having a wire plug-in hole for the conductive wire to plug into the interior of the case. The case defines a chamber containing a conductive support (or conductive component) and metal leaf spring. The metal leaf spring and the conductive component serve to press the conductive wire plugged into the case and contact or electrically connect with the conductive wire. Unless an operator uses a tool to extend into the case and push/press the metal leaf spring, the conductive wire cannot be released from the electrical connection or contact with the metal leaf spring and the conductive component. A switch wire connection device is a power switch component for connecting with a circuit. The switch wire connection device is installed on the operation panel or distributor box of an electronic or an electrical apparatus for connecting with the wiring circuit.

The third type of electrical terminal device is the switch wire connection device including a junction box or contact case (generally made of plastic material), a conductive component and a metal leaf spring (or a screw). The conductive component and the metal leaf spring are mounted in the junction box to press a wiring circuit or a conductive wire of an electronic or electrical apparatus. By means of operating a pushbutton of the switch, the conductive component and the metal leaf spring are controlled to electrically connect with or disconnect from the wiring circuit or the conductive wire so as to power on or power off the circuit.

In order to permit different diameters of conductive wires to plug into the terminal, the diameter of the wire plug-in hole of the terminal must be considerably larger than the diameter of the conductive wire to facilitate the operation. The assembling structure of the conventional wire connection terminal or device has some shortcomings in structural form and operation application as follows:

1. The diameter of the wire plug-in hole of the terminal is considerably larger than the diameter of the conductive wire. As a result, in practice, after a long period of use, dust, water or moisture is apt to enter and accumulate in the terminal to affect the electro-conductive performance.
2. The diameter of the wire plug-in hole of the terminal is considerably larger than the diameter of the conductive wire. This provides a larger space for the conductive wire to deflect. Therefore, the conductive wire is apt to deflect or swing due to incautious touch of an operator. This will lead to poor contact and insecurity.
3. In practice, when a multi-core conductive wire is plugged into the terminal, it often takes place that the cores of the multi-core conductive wire are spread or twisted. At this time, an operator needs to use a tool to push away the metal leaf spring so as to give a larger space for the conductive wire to pass through. Therefore, the operation is quite troublesome and time-costing.

In order to improve the shortcoming of the conventional wire connection terminal that dust, water or moisture is apt to enter and accumulate in the terminal, a conventional conic guide sleeve structure is provided to guide the conductive wire to plug into the terminal. The rear end of the guide sleeve is relatively tightly fitted with the conductive wire so as to prevent the dust, water or moisture from entering the terminal.

However, as well known by those who are skilled in this field, when the guide sleeve guides the conductive wire to the central axis of the guide sleeve, the metal leaf spring will press the conductive wire and linearly contact the conductive wire. Therefore, the electro-conductive area or electro-conductive performance can be hardly enhanced. Moreover, when the metal leaf spring presses the conductive wire, the metal leaf spring will press the conductive wire in a direction to the conductive component. At this time, the conic guide sleeve will be deformed to affect the dustproof, waterproof or moisture-proof effect. This is not what we expect.

To speak representatively, the above reveals some shortcomings existing in the conventional wire connection terminal or device in assembling structure design and application. In case the structure and assembling form of the metal leaf spring (or the conductive component) and the wire plug-in hole of the terminal and the guide sleeve are redesigned to be different from the conventional wire connection terminal, the use form of the wire connection terminal can be changed to practically widen the application range thereof.

For example, in the condition that the structure will not be deformed due to operation as the conventional terminal, a guide sleeve or an aid sleeve structure is provided to guide the conductive wire and help in fixing the conductive wire so as to truly prevent the dust, water or moisture from entering and accumulating in the terminal. Moreover, the electro-conductive contact area between the metal leaf spring (or the conductive component) of the terminal and the conductive wire is increased. Also, the structural form is changed to improve the shortcoming of the conventional terminal that an operator needs to additionally use a tool to push away the metal leaf spring and the operation is troublesome and time-costing. Furthermore, the aid sleeve eliminates the problem of the conventional terminal that the conductive wire is apt to deflect or swing due to incautious touch of an operator to lead to poor contact and insecurity.

SUMMARY OF THE INVENTION

It is therefore a primary object of the present invention to provide a wire plug-in aid sleeve structure for wire connection terminal, which provides dustproof and waterproof effects and is able to enhance the security of the conductive wire assembled with the terminal. The aid sleeve is assembled in a wire plug-in hole of the terminal. The aid sleeve includes a head section, a belly section connected with the head section and a tail section connected with the belly section. The head section, the belly section and the tail section together define a guide hole for the conductive wire to plug in. The tail section has a first side and a second side positioned on a peripheral section of the guide hole and two lateral sides connected with the first and second sides. After the conductive wire passes through the guide hole into the terminal, the metal leaf spring (and/or the conductive component) disposed in the terminal is facilitated to press the conductive wire toward the first side or the second side. This improves the shortcomings of the conventional terminal that the conductive wire is apt to deflect and swing and the contact is insecure to affect the electro-conductive efficiency and safety.

In the above wire plug-in aid sleeve structure for wire connection terminal, the first side and the second side of the tail section are notched, whereby the lateral sides of the tail section are formed as wing structures on two sides of the notches for restricting the plug-in direction of the conductive wire.

In the above wire plug-in aid sleeve structure for wire connection terminal, the wing structures (or positions) of the two lateral sides of the tail section are parallel to the moving path of the metal leaf spring, while the first side and the second side are normal to the moving path of the metal leaf spring. In a preferred embodiment, the position where the guide hole adjoins the first side or the second side has the form of a straight line (or plane face). This facilitates the metal leaf spring to press the conductive wire to the first side or the second side and flatten the conductive wire, whereby the conductive wire can linearly contact (or face contact) the metal leaf spring so as to enhance the effect and electro-conductive performance of the conductive wire. Also, the deflection or swing of the conductive wire due to collision of external force or assembling operation is as minimized as possible.

The present invention can be best understood through the following description and accompanying drawings, wherein:

BRIEF DESCRIPTION OF THE DRAWINGS

FIG. 3-1 is a sectional view of the present invention, showing the assembly of the guide hole of the aid sleeve and the conductive wire, wherein the solid lines of the drawing show that a conductive wire with smaller diameter contacts or frictionally interferes with the rib sections and the phantom lines show that a conductive wire with larger diameter frictionally interferes with the rib sections;

DETAILED DESCRIPTION OF THE PREFERRED EMBODIMENTS

Figure 1:
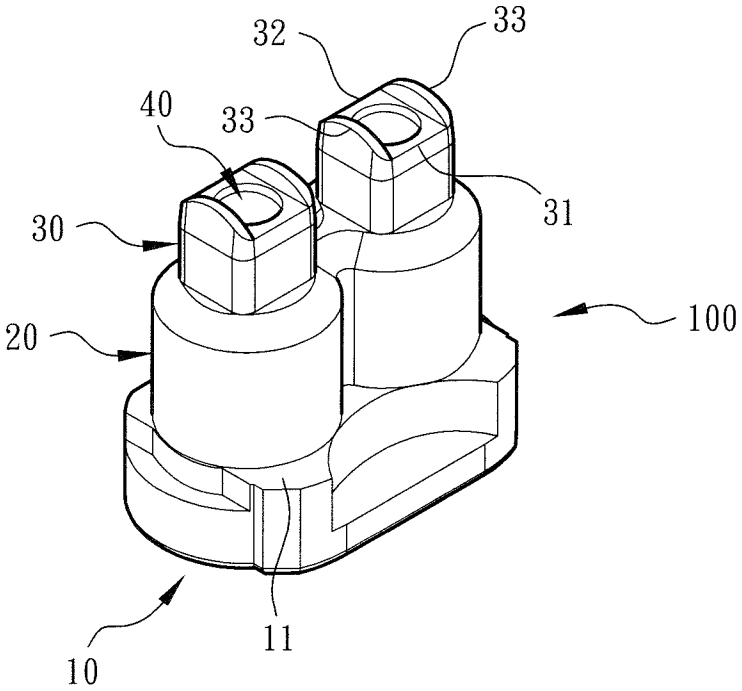
FIG. 1 is a perspective view of the present invention.
Figure 2:
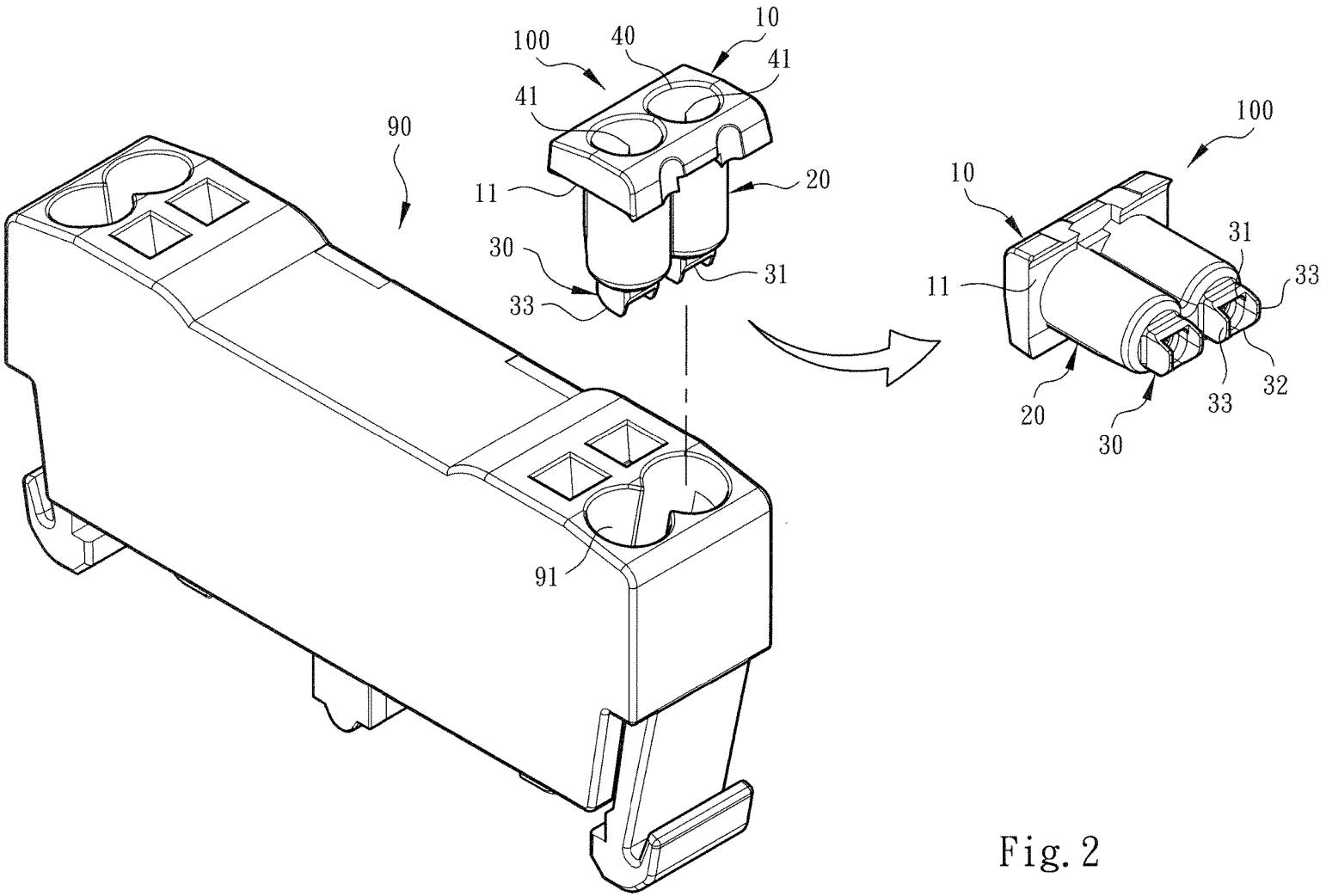
FIG. 2 is a perspective view of a modified embodiment of the present invention, showing the structures of the aid sleeve and the wire plug-in hole of the terminal.
Figure 3:
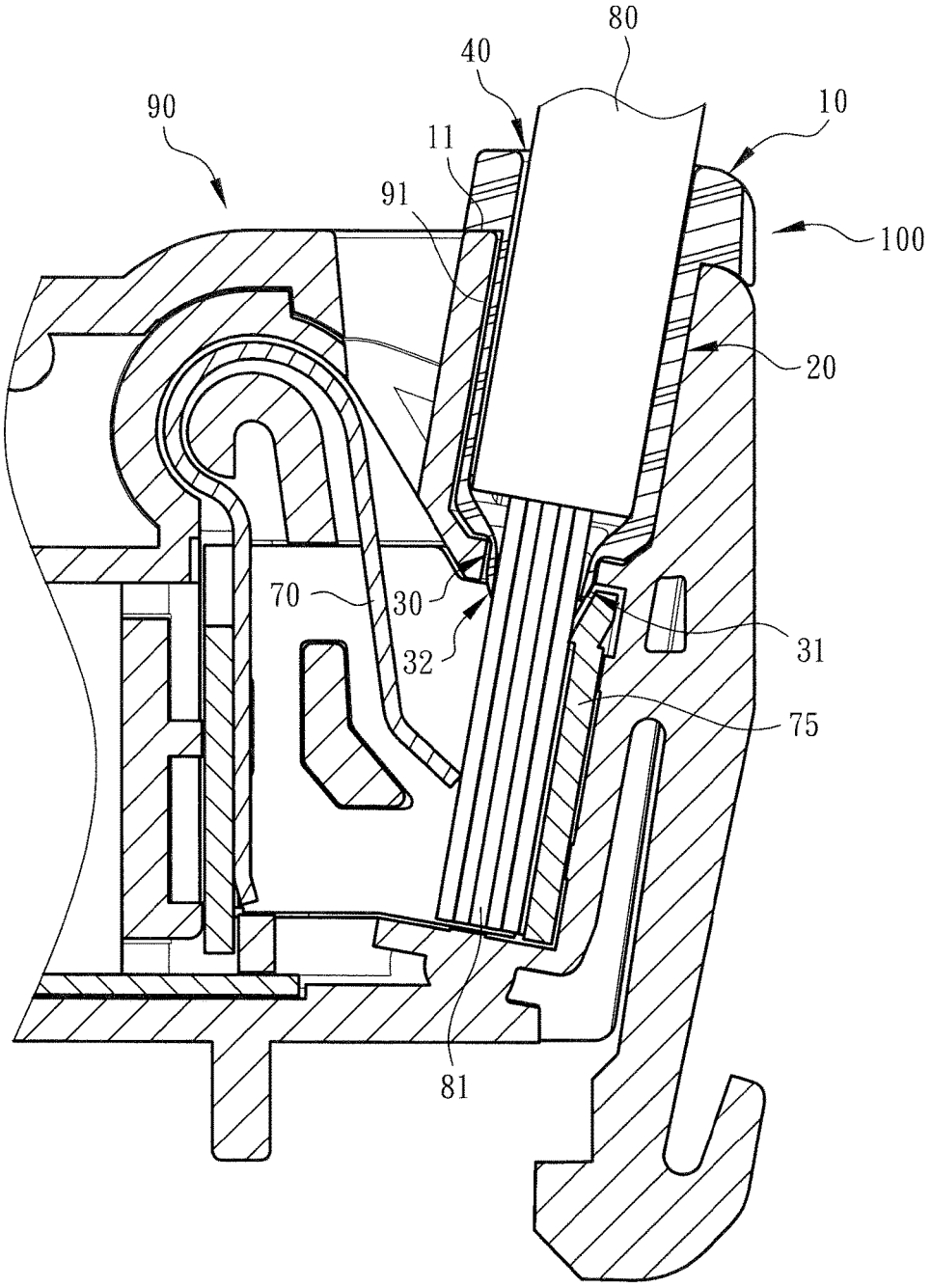
FIG. 3 is a sectional assembled view according to FIG. 2.
Figures 1, 3:
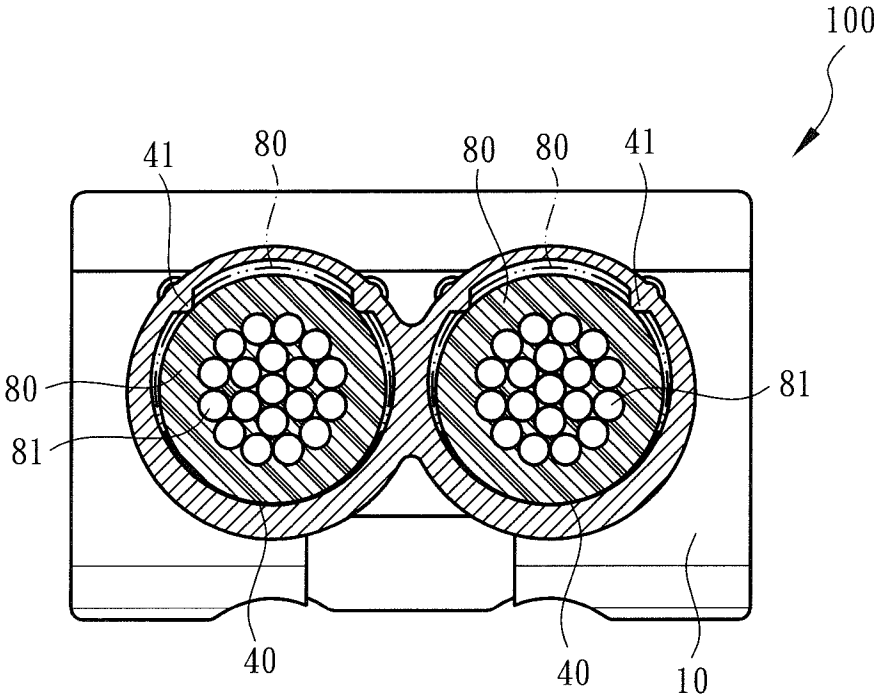

Please refer to FIGS. 1, 2 and 3. The wire plug-in aid sleeve structure for wire connection terminal of the present invention includes an aid sleeve 100 made of rubber, plastic or the like material. The aid sleeve 100 is mounted in the wire plug-in hole 91 of the terminal 90 for guiding the conductive wire 80 into the terminal 90.

As shown in the drawings, the aid sleeve 100 includes at least one head section 10, a belly section 20 connected with the head section 10 and a tail section 30 connected with the belly section 20. In this embodiment, the head section 10 of the aid sleeve 100 is connected with two cylindrical belly sections 20 and two tail sections 30 corresponding to the structural form of the terminal 90 that has two wire plug-in holes 91 on each side.

As shown in FIGS. 1, 2 and 3, the head section 10 has the form of a plate body having an area larger than the (cross-sectional) area of the belly sections 20. Accordingly, a shoulder section 11 is formed between the head section 10 and the belly sections 20. When mounting the aid sleeve 100 into the wire plug-in holes 91, the head section 10 or the shoulder section 11 presses on and covers the wire plug-in holes 91. The tail sections 30 protrude from the belly sections 20. The (cross-sectional) area of the belly sections 20 is larger than the (cross-sectional) area of the tail sections 30. The head section 10, the belly sections 20 and the tail sections 30 together define a guide hole 40 for the conductive wire 80 to plug in.

As shown in FIG. 3, at the junction between the belly section 20 and the tail section 30, the guide hole 40 is narrowed to form a tapered structure. In this case, the conductive wire 80 is enclosed in the head section 10 and the belly section 20 and only the core section 81 of the conductive wire 80 is permitted to pass through the tail section 30 into the terminal 90. Therefore, the aid sleeve 100 is tightly fitted in the wire plug-in holes 91 to enclose the conductive wire 80 so as to truly prevent dust, water or moisture from entering and accumulating in the terminal 90.

In this embodiment, the tail section 30 has a first side 31 and a second side 32 positioned on a peripheral section of the guide hole 40 and two lateral sides 33 connected with the first and second sides 31, 32. The first side 31 and/or the second side 32 of the tail section 30 are notched, whereby the lateral sides 33 of the tail section 30 are formed as wing structures on two sides of the notches for restricting the plug-in direction of the conductive wire 80 (or the core 81 of the conductive wire 80).

As shown in FIG. 1, the notch of the first side 31 and the notch of the second side 32 are positioned at the same height or the same depth. FIG. 2 shows that the recessed depth of the notch of the first side 31 is larger than the recessed depth of the notch of the second side 32 so that the height of the first side 31 is lower than the height of the second side 32. Therefore, as specifically shown in FIG. 3, after the conductive wire 80 passes through the guide hole 40 into the terminal 90, the metal leaf spring 70 disposed in the terminal 90 is facilitated to press the core 81 of the conductive wire 80 in a direction to the first side 31 against the conductive component 75.

It should be noted that the wing structures (or positions) of the two lateral sides 33 are parallel to the moving path of the metal leaf spring 70, while the first side 31 and/or the second side 32 are normal to the moving path of the metal leaf spring 70. In a preferred embodiment, the position where the guide hole 40 adjoins the first side 31 has the form of a straight line (or plane face). This facilitates the metal leaf spring 70 to press the conductive wire 80 (or the core 81) to the first side 31 and flatten the core 81 of the conductive wire 80, whereby the conductive wire 80 can linearly contact (or face contact) the metal leaf spring 70 so as to enhance the effect and electro-conductive performance of the conductive wire 80. Also, the deflection or swing of the conductive wire 80 due to collision of external force or assembling operation is as minimized as possible. This improves the shortcoming of the conventional terminal that the conductive wire is apt to deflect or swing and the contact is insecure to affect the electro-conductive efficiency and safety.

Please now refer to FIG. 3-1. In this embodiment, at least one or multiple rib sections 41 are disposed in the guide hole 40. The rib sections 41 are strip-like protrusion bodies formed on the inner wall of the guide hole 40. The solid lines of the drawing show that a conductive wire 80 with smaller diameter contacts (or frictionally interferes with) the rib sections 41. In this case, the conductive wire 80 with smaller diameter is prevented from moving laterally (or in other direction), whereby the stability of the conductive wire 80 connected with the terminal 90 and the electro-conductive efficiency of the conductive wire 80 are enhanced.

The phantom lines of the drawing show that a conductive wire 80 with larger diameter frictionally interferes with the rib sections 41 (or the rib sections 41 press the conductive wire 80). In this case, the conductive wire 80 with larger diameter is prevented from rotating or swinging.

It should be noted that the rib sections 41 of the guide hole 40 of the aid sleeve 100 enable the aid sleeve 100 or the guide hole 40 to assemble with or fix different diameters and specifications of conductive wires 80. Accordingly, the aid sleeve 100 can be commonly applied to different diameters and specifications of conductive wires 80 to widen the application range of the aid sleeve 100.

Figure 4:
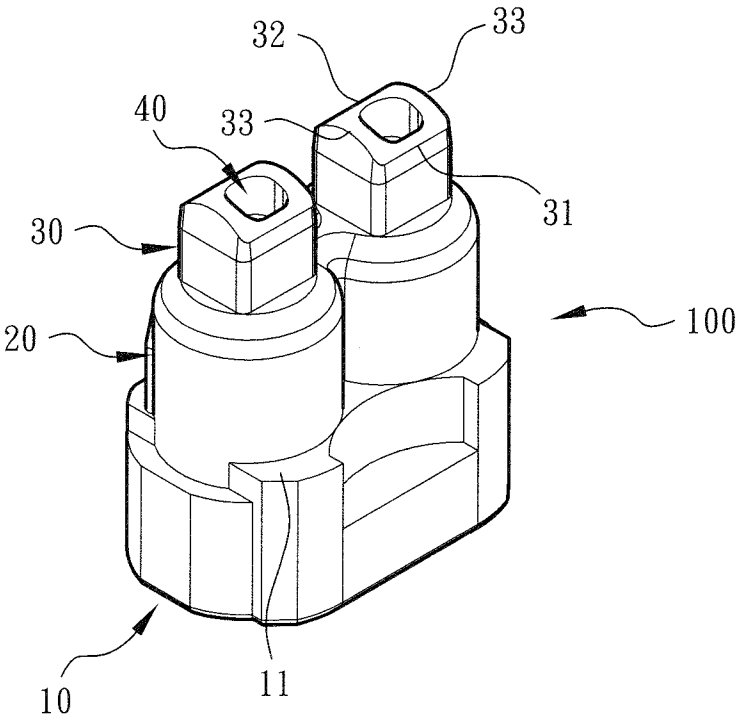
FIG. 4 is a perspective view of a preferred embodiment of the present invention.

Please now refer to FIG. 4. In a preferred embodiment, with the direction of the drawing serving as a reference basis, the guide hole 40 is tilted to the first side 31 of the tail section, whereby the height of the first side 31 is lower than the height of the second side 32. In addition, the position where the guide hole 40 adjoins the first side 31 has the form of a straight line (or plane face).

Figure 5:
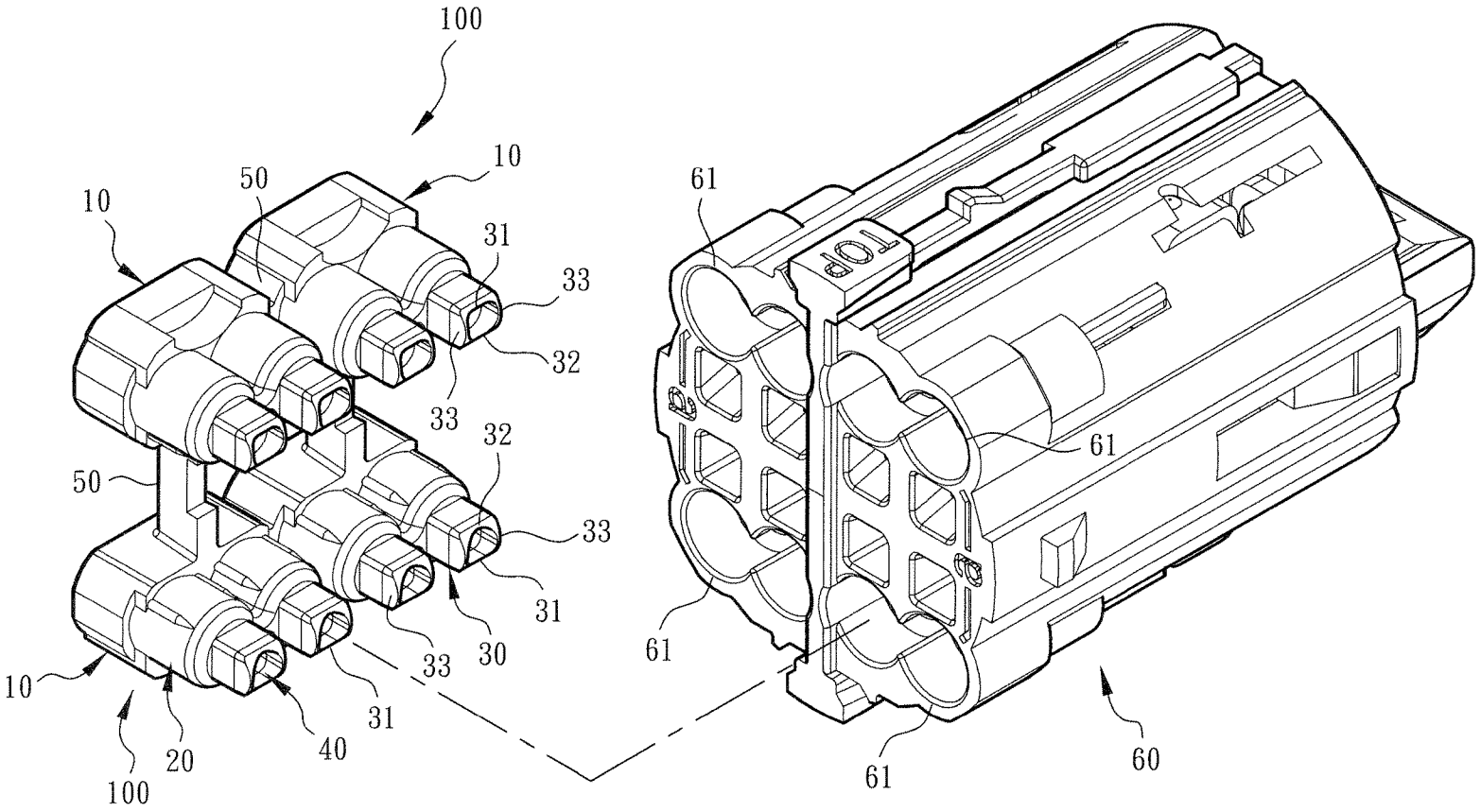
FIG. 5 is a perspective view of a modified embodiment of the present invention.

FIG. 5 shows a modified embodiment of the present invention. The switch wire connection device 60 is formed with 2-4 sets of wire plug-in holes 61. Accordingly, 2-4 sets of aid sleeves 100 are provided corresponding to the 2-4 sets of wire plug-in holes 61. A connection support 50 is disposed between each two aid sleeves 100 and connected between the head sections 10 of the aid sleeves 100. In this case, an operator can directly operate and press the aid sleeves 100 into the 2-4 sets of wire plug-in holes 61 of the switch wire connection device 60.

To speak representatively, in comparison with the conventional terminal device, the wire plug-in aid sleeve structure for wire connection terminal of the present invention has the following advantages:

1. The aid sleeve 100 and the relevant cooperative components and structures have been redesigned. For example, the aid sleeve 100 includes a head section 10, a belly section 20 and a tail section 30. The tail section 30 has a first side 31 and a second side 32 and/or two lateral sides 33 formed as wing structures. The first side 31 and/or the second side 32 are notched or the height (or position) of the first side 31 is lower than the height (or position) of the second side 32 so that the position where the guide hole 40 adjoins the first side 31 and/or the second side 32 has the form of a straight line or a plane face. The present invention is obviously different from the conventional terminal device in use and operation form. Also, the present invention changes the electro-conductive structure or assembling relationship of the conventional terminal device.
2. Especially, the aid sleeve 100 serves to guide the conductive wire 80 and help in fixing the conductive wire 80. Also, the aid sleeve 100 will not be deformed in operation as the conventional terminal so that the aid sleeve 100 can truly prevent dust, water or moisture from entering and accumulating in the terminal. Moreover, the aid sleeve 100 increases the electro-conductive contact area between the metal leaf spring 70 (or the conductive component 75) of the terminal 90 (or the switch wire connection device 60) and the core 81 of the conductive wire. According to the structural form of the convention terminal device, it is necessary to additionally use a tool to push away the metal leaf spring. This is troublesome and time-costing. Also, the conductive wire is apt to deflect or swing due to incautious touch of an operator. This will lead to poor contact and insecurity. The aid sleeve 100 of the present invention apparently improves these shortcomings of the conventional terminal device.

In conclusion, the wire plug-in aid sleeve structure for wire connection terminal of the present invention is different from the conventional terminal device in space form and is advantageous over the conventional terminal device. The wire plug-in aid sleeve structure for wire connection terminal of the present invention is greatly advanced and inventive.

The above embodiments are only used to illustrate the present invention, not intended to limit the scope thereof. Many modifications of the above embodiments can be made without departing from the spirit of the present invention.

What is claimed is:

1. A wire plug-in aid sleeve structure for wire connection terminal, comprising an aid sleeve configured for mounting in a wire plug-in hole of a terminal or a wire plug-in hole of a switch wire connection device, the aid sleeve having a head section, a belly section connected with the head section, and a tail section connected with the belly section, the head section, the belly section and the tail section together defining a guide hole, the tail section having a first side and a second side positioned on a peripheral section of the guide hole and two lateral sides connected with the first and second sides.

2. The wire plug-in aid sleeve structure for wire connection terminal as claimed in claim 1, wherein the head section of the aid sleeve is connected with two cylindrical belly sections and two tail sections.

3. A wire plug-in aid sleeve structure for wire connection terminal, comprising an aid sleeve, the aid sleeve having a head section, a belly section connected with the head section, and a tail section connected with the belly section, the head section, the belly section, and the tail section together defining a guide hole, the tail section having a first side and a second side positioned on a peripheral section of the guide hole and two lateral sides connected with the first and second sides, wherein the head section forms a plate body having an area larger than a cross-sectional area of the belly section, whereby a shoulder section is formed between the head section and the belly section, the tail section protruding from the belly section, the cross-sectional area of the belly section being larger than a cross-sectional area of the tail section, the guide hole being narrowed to form a tapered structure at a junction between the belly section and the tail section.

4. The wire plug-in aid sleeve structure for wire connection terminal as claimed in claim 2, wherein the head section has the form of a plate body having an area larger than a cross-sectional area of the belly sections, whereby a shoulder section is formed between the head section and the belly sections, the tail sections protruding from the belly sections, the cross-sectional area of the belly sections being larger than a cross-sectional area of the tail sections, the guide hole being narrowed to form a tapered structure at a junction between the belly section and the tail section.

5. The wire plug-in aid sleeve structure for wire connection terminal as claimed in claim 1, wherein at least one of the first and second sides of the tail section is notched, whereby the lateral sides of the tail section is formed as wing structures on two sides of the notch.

6. The wire plug-in aid sleeve structure for wire connection terminal as claimed in claim 3, wherein at least one of the first and second sides of the tail section is notched, whereby the lateral sides of the tail section is formed as wing structures on two sides of the notch.

7. The wire plug-in aid sleeve structure for wire connection terminal as claimed in claim 2, wherein at least one of the first and second sides of the tail section is notched, whereby the lateral sides of the tail section is formed as wing structures on two sides of the notch, the wing structures of the lateral sides being parallel to a moving path of the metal leaf spring, while the first side and the second side being normal to the moving path of the metal leaf spring.

8. The wire plug-in aid sleeve structure for wire connection terminal as claimed in claim 4, wherein at least one of the first and second sides of the tail section is notched, whereby the lateral sides of the tail section is formed as wing structures on two sides of the notch, the wing structures of the lateral sides being parallel to a moving path of the metal leaf spring, while the first side and the second side being normal to the moving path of the metal leaf spring.

9. The wire plug-in aid sleeve structure for wire connection terminal as claimed in claim 5, wherein the notch of the first side and the notch of the second side are positioned at the same height.

10. The wire plug-in aid sleeve structure for wire connection terminal as claimed in claim 6, wherein the notch of the first side and the notch of the second side are positioned at the same height.

11. The wire plug-in aid sleeve structure for wire connection terminal as claimed in claim 7, wherein the notch of the first side and the notch of the second side are positioned at the same height.

12. The wire plug-in aid sleeve structure for wire connection terminal as claimed in claim 8, wherein the notch of the first side and the notch of the second side are positioned at the same height.

13. The wire plug-in aid sleeve structure for wire connection terminal as claimed in claim 5, wherein the recessed depth of the notch of the first side is larger than the recessed depth of the notch of the second side, whereby the height of the first side is lower than the height of the second side.

14. The wire plug-in aid sleeve structure for wire connection terminal as claimed in claim 6, wherein the recessed depth of the notch of the first side is larger than the recessed depth of the notch of the second side, whereby the height of the first side is lower than the height of the second side.

15. The wire plug-in aid sleeve structure for wire connection terminal as claimed in claim 7, wherein the recessed depth of the notch of the first side is larger than the recessed depth of the notch of the second side, whereby the height of the first side is lower than the height of the second side.

16. The wire plug-in aid sleeve structure for wire connection terminal as claimed in claim 8, wherein the recessed depth of the notch of the first side is larger than the recessed depth of the notch of the second side, whereby the height of the first side is lower than the height of the second side.

17. The wire plug-in aid sleeve structure for wire connection terminal as claimed in claim 1, wherein the guide hole is tilted to the first side of the tail section, whereby the height of the first side is lower than the height of the second side.

18. The wire plug-in aid sleeve structure for wire connection terminal as claimed in claim 2, wherein the guide hole is tilted to the first side of the tail section, whereby the height of the first side is lower than the height of the second side.

19. The wire plug-in aid sleeve structure for wire connection terminal as claimed in claim 3, wherein the guide hole is tilted to the first side of the tail section, whereby the height of the first side is lower than the height of the second side.

20. The wire plug-in aid sleeve structure for wire connection terminal as claimed in claim 4, wherein the guide hole is tilted to the first side of the tail section, whereby the height of the first side is lower than the height of the second side.

21. The wire plug-in aid sleeve structure for wire connection terminal as claimed in claim 1, wherein a position where the guide hole adjoins the first side has the form of a straight line or a plane face, at least one rib section being disposed in the guide hole, the rib section being a strip-like protrusion body formed on an inner wall of the guide hole.

22. The wire plug-in aid sleeve structure for wire connection terminal as claimed in claim 2, wherein a position where the guide hole adjoins the first side has the form of a straight line or a plane face, at least one rib section being disposed in the guide hole, the rib section being a strip-like protrusion body formed on an inner wall of the guide hole.

23. The wire plug-in aid sleeve structure for wire connection terminal as claimed in claim 3, wherein a position where the guide hole adjoins the first side has the form of a straight line or a plane face, at least one rib section being disposed in the guide hole, the rib section being a strip-like protrusion body formed on an inner wall of the guide hole.

24. The wire plug-in aid sleeve structure for wire connection terminal as claimed in claim 4, wherein a position where the guide hole adjoins the first side has the form of a straight line or a plane face, at least one rib section being disposed in the guide hole, the rib section being a strip-like protrusion body formed on an inner wall of the guide hole.

25. The wire plug-in aid sleeve structure for wire connection terminal as claimed in claim 17, wherein a position where the guide hole adjoins the first side has the form of a straight line or a plane face, at least one rib section being disposed in the guide hole, the rib section being a strip-like protrusion body formed on an inner wall of the guide hole.

26. The wire plug-in aid sleeve structure for wire connection terminal as claimed in claim 18, wherein a position where the guide hole adjoins the first side has the form of a straight line or a plane face, at least one rib section being disposed in the guide hole, the rib section being a strip-like protrusion body formed on an inner wall of the guide hole.

27. The wire plug-in aid sleeve structure for wire connection terminal as claimed in claim 1, wherein there are at least two sets of aid sleeves, a connection support being disposed between each two aid sleeves and connected between the head sections of the aid sleeves, a position where the guide hole adjoins the first side having the form of a straight line or a plane face.

28. The wire plug-in aid sleeve structure for wire connection terminal as claimed in claim 2, wherein there are at least two sets of aid sleeves, a connection support being disposed between each two aid sleeves and connected between the head sections of the aid sleeves, a position where the guide hole adjoins the first side having the form of a straight line or a plane face.

29. The wire plug-in aid sleeve structure for wire connection terminal as claimed in claim 3, wherein there are at least two sets of aid sleeves, a connection support being disposed between each two aid sleeves and connected between the head sections of the aid sleeves, a position where the guide hole adjoins the first side having the form of a straight line or a plane face.

30. The wire plug-in aid sleeve structure for wire connection terminal as claimed in claim 4, wherein there are at least two sets of aid sleeves, a connection support being disposed between each two aid sleeves and connected between the head sections of the aid sleeves, a position where the guide hole adjoins the first side having the form of a straight line or a plane face.

31. The wire plug-in aid sleeve structure for wire connection terminal as claimed in claim 17, wherein there are at least two sets of aid sleeves, a connection support being disposed between each two aid sleeves and connected between the head sections of the aid sleeves, a position where the guide hole adjoins the first side having the form of a straight line or a plane face.

32. A wire plug-in aid sleeve structure for wire connection terminal, comprising an aid sleeve, the aid sleeve having a head section, a belly section connected with the head section, and a tail section connected with the belly section, the head section, the belly section and the tail section together defining a guide hole open at both ends of the aid sleeve, the tail section having a first side and a second side positioned on a peripheral section of the guide hole and two lateral sides connected with the first and second sides.

* * * * *